US011466648B1

(12) United States Patent
Ricketts

(10) Patent No.: US 11,466,648 B1
(45) Date of Patent: Oct. 11, 2022

(54) WATER INGESTION CONTROL SYSTEM FOR VEHICLE, WATER INGESTION AND EVACUATION SYSTEM FOR VEHICLE, VEHICLE INCLUDING SAME, AND METHOD

(71) Applicant: Honda Motor Co., Ltd., Tokyo (JP)

(72) Inventor: Brandon E. Ricketts, Marysville, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/540,718

(22) Filed: Dec. 2, 2021

(51) Int. Cl.
*F02M 35/08* (2006.01)
*F02M 35/10* (2006.01)

(52) U.S. Cl.
CPC .... *F02M 35/088* (2013.01); *F02M 35/10209* (2013.01); *F02M 35/10255* (2013.01); *F02M 35/10393* (2013.01)

(58) Field of Classification Search
CPC ..... F02M 35/088; F02M 35/10209; F02M 35/10255; F02M 35/10393; F02M 35/021; F02M 35/10144; F02M 35/10006; F02M 35/10104; F02M 35/162; B60K 13/02; B60K 13/06; F02B 77/00
See application file for complete search history.

(56) References Cited

U.S. PATENT DOCUMENTS

| | | | | |
|---|---|---|---|---|
| 6,453,866 | B1 | 9/2002 | Altmann et al. | |
| 6,510,832 | B2 | 1/2003 | Maurer et al. | |
| 6,564,768 | B2 * | 5/2003 | Bauer | F02M 35/024 55/385.3 |
| 7,455,042 | B2 | 11/2008 | Jacobi-Hinderer | |
| 8,939,126 | B2 | 1/2015 | Li et al. | |
| 9,637,132 | B2 | 5/2017 | Clarke et al. | |
| 9,683,527 | B2 | 6/2017 | Tallman | |
| 10,352,287 | B2 | 7/2019 | Chen et al. | |
| 10,479,194 | B1 | 11/2019 | Johnson et al. | |
| 10,920,688 | B2 | 2/2021 | Llusho et al. | |
| 2011/0196596 | A1 | 8/2011 | Schleser et al. | |
| 2014/0360794 | A1 | 12/2014 | Tallman | |
| 2017/0130683 | A1 * | 5/2017 | Somerville | F02M 35/10327 |
| 2021/0190019 | A1 | 6/2021 | Vite Cadena | |

FOREIGN PATENT DOCUMENTS

| | | | |
|---|---|---|---|
| CN | 204783365 | U | 11/2015 |
| JP | 2004218463 | A | 8/2004 |

* cited by examiner

*Primary Examiner* — Syed O Hasan
(74) *Attorney, Agent, or Firm* — Kenealy Vaidya LLP

(57) ABSTRACT

A water ingestion control system for an internal combustion engine can include a snorkel, at least one closure structure, a choking valve, and a controller. The snorkel can include an air intake opening and at least one evacuation inlet that can be selectively opened and closed by the closure structure. The choking valve can be located between the air intake opening and an air box and selectively open and close fluid communication between the snorkel and the air box. When in a closed state, the choking valve can close fluid communication between the snorkel and the air box and prevents fluid in the snorkel from flowing into the air box and the engine. The controller can be configured to place the choking valve in the closed state when the controller receives data indicative of the presence of water in the snorkel.

20 Claims, 4 Drawing Sheets

WATER INGESTION CONTROL SYSTEM FOR VEHICLE, WATER INGESTION AND EVACUATION SYSTEM FOR VEHICLE, VEHICLE INCLUDING SAME, AND METHOD

BACKGROUND

The disclosed subject matter relates to a vehicle configured to travel off-road. More particularly, the disclosed subject matter relates to methods and apparatus that control the ingestion of water into an internal combustion engine, and methods and apparatus that evacuate water from a water ingestion control system.

Some vehicles can be configured for travel along an improved path such as a paved road or highway as well as for travel along an unimproved path such as a dirt trail or across unmarked and uneven terrain such as through wooded areas, sand, open fields and rocky terrain. While traveling along an unimproved or unmarked path the vehicle can encounter numerous water obstacles such as but not limited to standing water, creeks, streams and rivers. In severe weather conditions it may also be possible for a vehicle to experience water obstacles on improved pathways. The vehicle can be configured with an intake snorkel which has an opening elevated above the internal combustion engine of the vehicle at a predetermined height. The snorkel can permit the vehicle to ford a water obstacle that is no deeper than a predetermined depth without ingesting water from the water obstacle. The predetermined depth can be any appropriate depth that the driver perceives as a safe and reliable operation of the vehicle. For example, predetermined depth can be based on a hip point height or an eye point height for an operator of the vehicle.

SUMMARY

Some embodiments are directed to a water ingestion control system for an internal combustion engine connected to an air box and an exhaust pipe. The water ingestion control system can include a snorkel, a plurality of closure structures, a choking valve, and a controller. The snorkel can be connected to the air box and include an air intake opening and a plurality of evacuation inlets spaced apart from each other. A respective one of the closure structures selectively opens and closes a respective one of the evacuation inlets. The choking valve can be located between the air intake opening and the air box and selectively operated between an opened state in which the choking valve opens fluid communication between the snorkel and the air box and allows air flowing through the snorkel to enter the air box, and a closed state in which the choking valve closes fluid communication between the snorkel and the air box and prevents fluid in the snorkel from flowing into the air box and the internal combustion engine. The controller can be in electrical communication with the choking valve and configured to place the choking valve in the closed state when the controller receives data indicative of the presence of water in the snorkel.

Some embodiments are directed to a vehicle that can include a frame assembly, at least one body panel mounted on the frame assembly, an internal combustion engine mounted on the frame assembly, an airbox housing a filter, a snorkel, a closure structure, a choking valve, a controller, a compressed air storage tank, at least one line, and an air compressor. The snorkel can be connected to the air box and include an air intake opening and at least one evacuation inlet. The closure structure can be configured to close the at least one evacuation inlet. The choking valve can be between the air intake opening and the air box and selectively operated between an opened state in which the choking valve opens fluid communication between the snorkel and the air box and allows air flowing through the snorkel to enter the air box and flow into the internal combustion engine, and closed state in which the choking valve closes fluid communication between the air box and the internal combustion engine and prevents fluid in the snorkel from exiting the snorkel and flowing into the air box and the internal combustion engine. The controller can be in electrical communication with the choking valve and configured to place the choking valve in the closed state when the controller receives data indicative of the presence of water in the snorkel. The at least one line can be configured for connecting the compressed air storage tank to the at least one evacuation inlet. The air compressor can be connected to the compressed air storage tank and configured to maintain a predetermined pressure in the compressed air storage tank.

Some embodiments are directed to a water ingestion and evacuation system for a vehicle including an internal combustion engine, an air box connected to the engine and an exhaust pipe connected to the engine. The water ingestion and evacuation system can include a snorkel, a closure structure, a choking valve, a moisture sensor, a controller, and a one-way valve. The snorkel can be connected to the air box and include a first end, a second end, an air intake opening at the first end, and at least one evacuation inlet spaced apart from each of the first end and the second end. The closure structure can close the at least one evacuation inlet. The choking valve can be located between the air intake opening and the air box and selectively operated between an opened state in which the choking valve opens fluid communication between the snorkel and the air box and allows air flowing through the snorkel to enter the air box, and a closed state in which the choking valve closes fluid communication between the snorkel and the air box and prevents fluid in the snorkel from flowing into the air box and the internal combustion engine. The controller can be in electrical communication with the choking valve and the moisture sensor and configured to place the choking valve in the closed state when the controller receives from the moisture sensor the data indicative of the presence of water in the snorkel. The one-way valve can be mounted on the exhaust pipe, open when the choking valve is in the opened state and exhaust gas flows through the exhaust pipe, and close when the choking valve is in the closed state and exhaust gas ceases to flow through the exhaust pipe.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

During operation of a vehicle, it is possible that an operator of the vehicle can misjudge the depth of a water obstacle while fording the water obstacle. As a result, it is possible for the internal combustion engine of the vehicle to ingest water, which can stall the engine and possibly damage the engine. Before attempting to restart the engine, the vehicle should be extricated from the water obstacle and water should be drained from the engine, the exhaust system and the air intake system in order to avoid any further damage. Further, the engine oil should be drained from the engine and replaced with fresh oil. Draining the water from the engine, air intake system and exhaust system can require extensive manual labor to disconnect the air intake system and exhaust system from the engine, disassemble at least a portion of the engine, and empty the water from these systems and the engine. It might be necessary to perform this manual labor on dry land adjacent to the water obstacle if the vehicle cannot be towed or trailered to a suitable repair environment. This can exacerbate the manual labor required to properly drain the water from the engine, the intake system and the exhaust system. Thus, it can be advantageous to provide a vehicle with a water ingestion control system that can prevent water from entering the engine and the exhaust system if the vehicle is driven into a water obstacle whose depth exceeds a predetermined wading depth rating for the vehicle. Further, it can be advantageous to provide a vehicle with a water ingestion and evacuation system that can prevent water from entering the engine and the exhaust system and permit an easy evacuation of any water in the intake system without disassembling the intake system from the engine or the vehicle.

Figure 1:
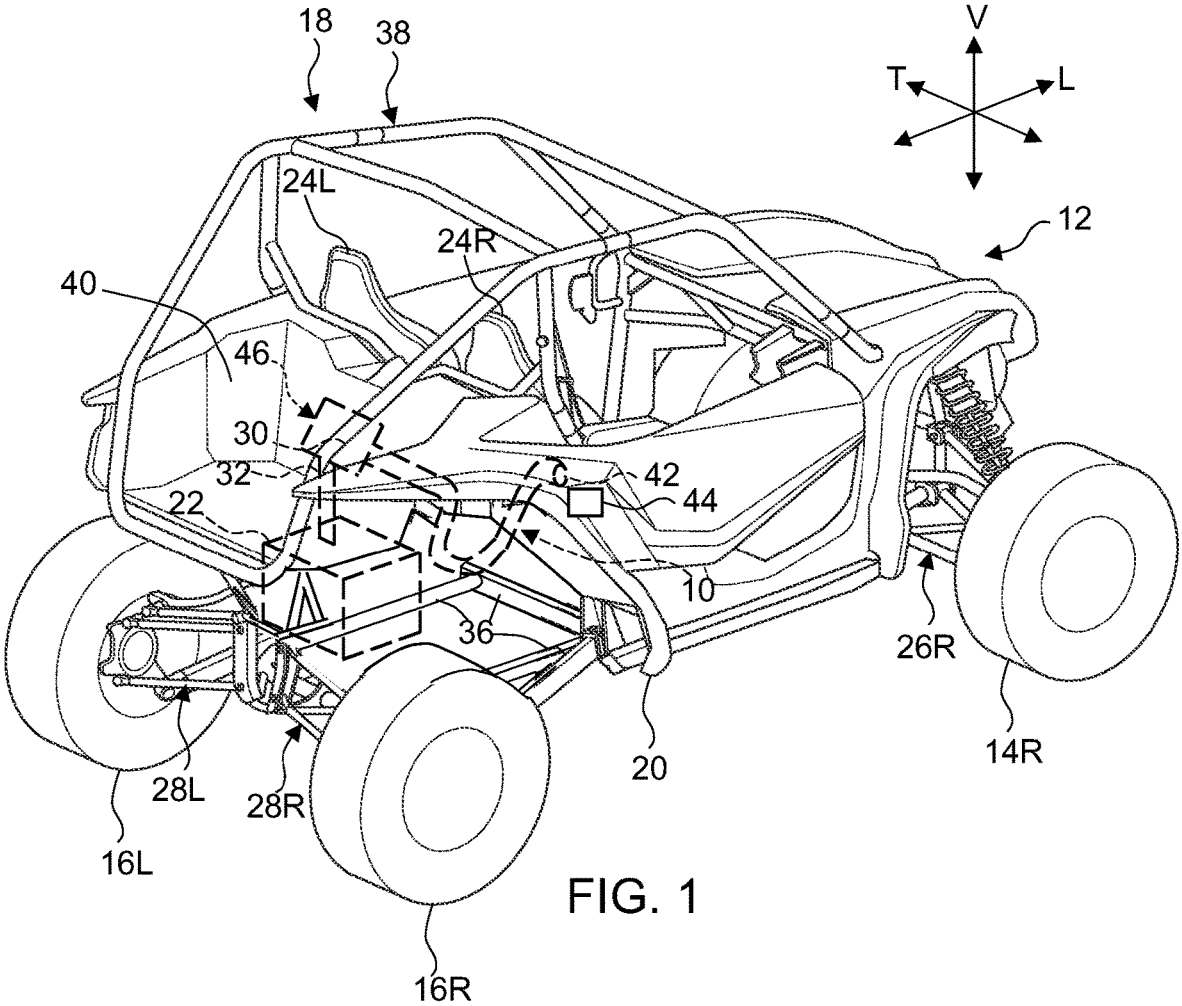
FIG. 1 is a perspective view of a vehicle including schematic representation of a water ingestion control system in accordance with principles of the disclosed subject matter.

FIG. 1 is a perspective view of an exemplary vehicle 12 including a water ingestion control system 10 made in accordance with principles of the disclosed subject matter. The vehicle 12 shown in FIG. 1 is specialized for use on an unimproved path or on an unmarked path, and can be referred to as a multipurpose utility vehicle (MUV) or as a side-by-side all-terrain vehicle (SxS, or SxS ATV).

However, the disclosed water ingestion control system 12 can be used with any vehicle that is configured for travel along any one or combination of improved, unimproved, and unmarked paths. For example, embodiments are intended to include or otherwise cover any type of automobile, including a passenger car, minivan, truck, other types of all-terrain vehicle (ATV), semi-tractor, off-highway vehicle, etc.

FIGS. 1-4 schematically illustrate a water ingestion control system 10 for the vehicle 12. The water ingestion control system 10 is shown in phantom in FIGS. 1 and 2. The water ingestion control system 10 can be configured to detect the presence of water in an air intake system 46 for an internal combustion engine 22. The water ingestion control system 10 can close and seal the air intake system 46 upstream of an air box 30 so that the engine 22 ingests little or no water if the vehicle 12 fords a water obstacle that exceeds the wading depth rating for the vehicle 12. The wading depth rating can be a predetermined depth of water through which the vehicle 12 may ford without ingesting an amount of water into the air intake system 46 and the engine 22 that can stall the engine 22 and/or cause damage to the engine 22. The wading depth rating can be any appropriate depth that the driver perceives as providing a safe and reliable operation of the vehicle. For example, wading depth rating can be based on a hip point height or an eye point height for an operator of the vehicle.

Figure 2:
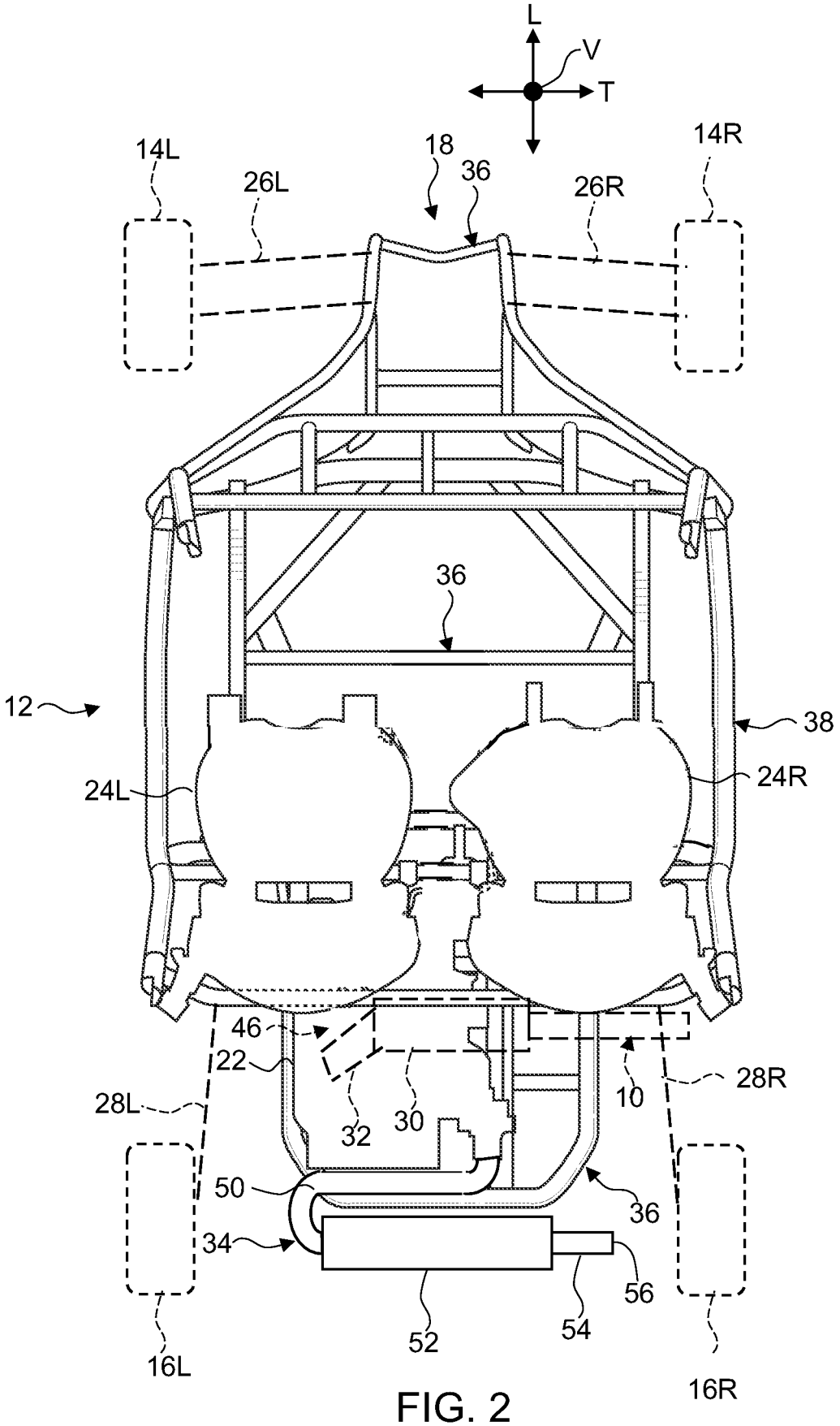
FIG. 2 is a top view of the vehicle of FIG. 1 with all the body panels of the vehicle removed.

Referring to FIGS. 1 and 2 collectively, the vehicle 12 can extend in a longitudinal direction L, a transverse direction T, and a vertical direction V and include a pair of front wheels 14L, 14R, a pair of rear wheels 16L, 16R, a frame assembly 18, at least one body panel 20, the internal combustion engine 22, a pair of seats 24L, 24R, front suspension assemblies 26L, 26R, rear suspension assemblies 28L, 28R, the air box 30, an intake conduit 32 and an exhaust system 34. The left front wheel 14L and the left front suspension assembly 26R are obstructed from view by the vehicle 12. The engine 22 is shown in phantom in FIG. 1 and in silhouette in FIG. 2. FIG. 2 schematically represents the wheels 14L, 14R, 16L, 16R, the front suspension assemblies 26L, 26R and the rear suspension assemblies 28L, 28R in phantom. Portions of the rear suspension assemblies 28L, 28 and the exhaust system 34 are omitted from FIG. 1 for clarity and simplicity of the drawing.

The frame assembly 18 can include a main frame assembly 36 and a roll protection system 38. The main frame assembly 36 can support all of the components and systems of the vehicle 12, including but not limited to the suspension assemblies 26L, 26R, 28L, 28R, the engine 22, and the passenger(s) seated in the seats 24L, 24R. The roll protection system 38 can be connected to and extend away from the main frame assembly 36 generally in the vertical direction V of the vehicle 12 and encircle at least a passenger space of the vehicle 12 in which the seats 24L, 24R are mounted. An upper portion of the roll protection system 38 is omitted from FIG. 2 for clarity and simplicity of the drawing.

Referring to FIG. 1, the vehicle 12 can include a plurality of body panels, in addition to the body panel 20, that cover respective portions of the frame assembly 18. All of the body panels have been omitted from FIG. 2 for clarity and simplicity of the drawing. The vehicle 12 can include a cargo space 40 behind the seats 24L, 24R. The body panel 20 can be adjacent to the cargo space 40.

The engine 22 can be mounted on the main frame assembly 36 at a location that is underneath the cargo space 40 in the vertical direction V of the vehicle 12. The engine 22 can drive the rear wheels 16L, 16R alone or in combination with the front wheels 14L 14R in any appropriate manner. Details of the drivetrain are omitted from FIGS. 1 and 2 for clarity and simplicity of the drawings.

FIGS. 1 and 2 schematically represent an exemplary location of the water ingestion control system 10 relative to the engine 22, the air box 30, the body panel 20 and the right rear wheel 16L. The water ingestion control system 10 can be spaced above the engine 22 in the vertical direction V of the vehicle 12 and spaced away from the engine 22 in the transverse direction T of the vehicle 12. The water ingestion control system 10 can extend away from the air box 30 and toward the outer side of the vehicle 12 in the transverse direction T of the vehicle 12. The water ingestion control system 10 can be covered by the body panel 20, but can also extend out of a body panel and form part of the rugged aesthetic of the vehicle 12.

Figure 3:
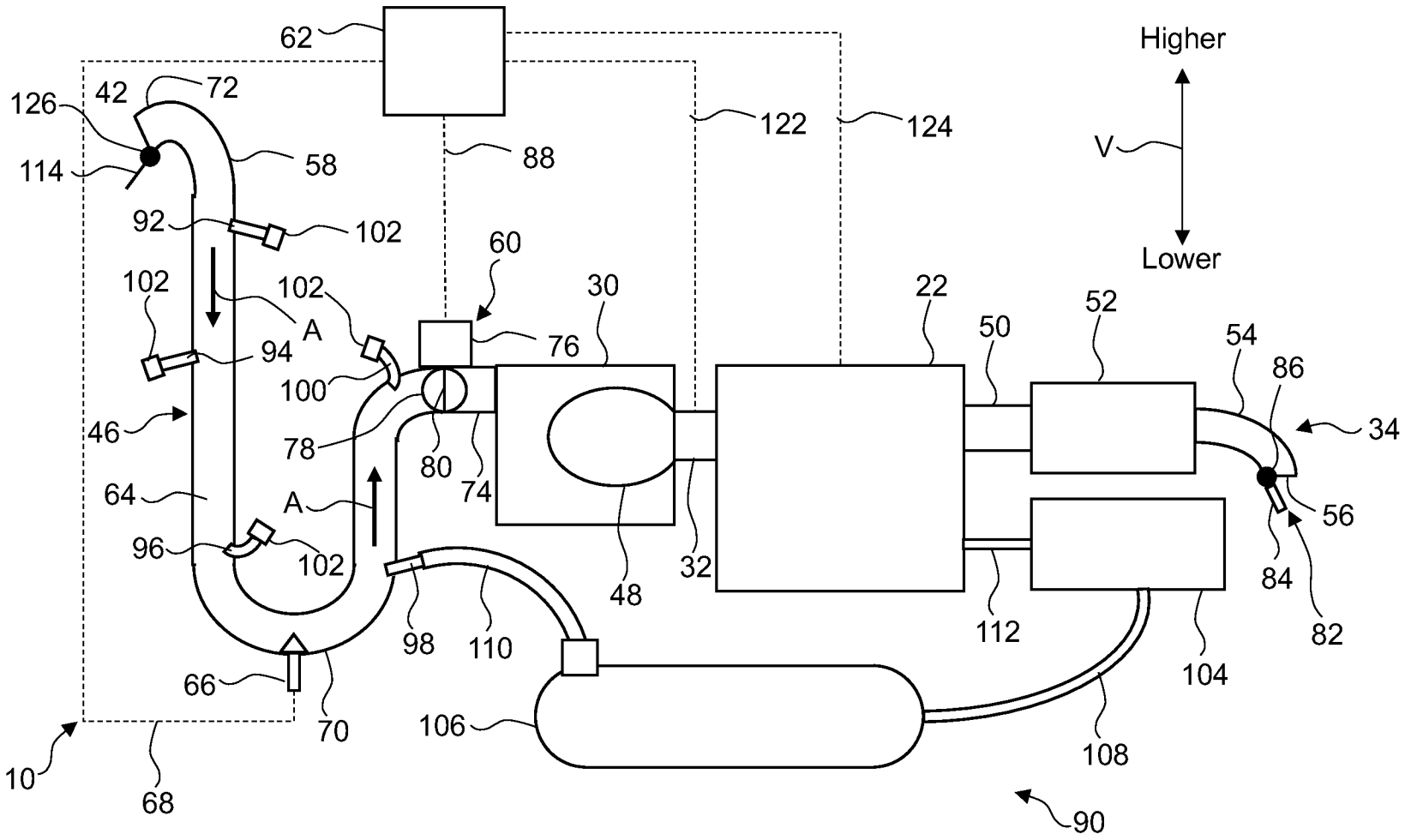
FIG. 3 is a schematic representation of a first embodiment of the water ingestion system of FIG. 1 and a first embodiment of a water evacuation system in accordance with principles of the disclosed subject matter.

The water ingestion control system 10 can be part of the air intake system 46 for the engine 22 as shown schematically in FIGS. 1-3. Referring to FIGS. 1 and 3, the water ingestion control system 10 can include a first opening 42. The body panel 20 can include a second opening 44 that is in fluid communication with the opening 42 so ambient air outside of the vehicle 12 passes through the body panel 20 and enters the first opening 42 of the water ingestion control system 10. That is, the opening 42 is in fluid communication with the opening 44. The elevation of the openings 42, 44 can be set in the vertical direction V relative to the travel surface to provide the predetermined wading depth rating. If the vehicle 12 fords a water obstacle having a depth greater than the wading depth rating, water can enter into the air intake system 46 through the opening 44 in the body panel 20.

FIG. 3 schematically illustrates the intake air system 46, the water ingestion control system 10, the engine 22 and the exhaust system 34. In addition to the water ingestion control system 10, the air intake system 46 can include the air box 30, a filter 48 and the intake conduit 32. The intake conduit 32 can include a throttle body that selectively opens and closes in response to an operator of the vehicle applying an input to an accelerator pedal adjacent to one of the seats 24L, 24R in order to increase, maintain, or decrease the speed of the engine 22. The engine 22 can include at least one piston and cylinder combination. If the engine 22 includes more than one piston and cylinder combination, the intake conduit 32 can include a respective fluid pathway for each cylinder that can diverge from a single fluid pathway connected to the air box 30 and extend to a respective one of the cylinders. The intake conduit 32 can also be referred to as an intake manifold.

Referring to FIG. 3, the water ingestion control system 10 can include a snorkel 58, a choke valve 60 and a controller 62. The controller 62 can be configured to cause the choke valve 60 to move from an opened state to a closed state in response to data received by the controller 62 that indicates the presence of water inside the snorkel 58. When in the open state, fluid flowing through a fluid passage 64 of the snorkel 58 can pass through the choke valve 60 and flow into the air box 30. When in the closed state, the choke valve 60 can close and seal the fluid passage 64 in the snorkel 58. Thus, the choke valve 60 can deprive a flow of oxygen and water to the engine 22 when the choke valve 60 is in the closed state. In response, the engine 22 can no longer maintain internal combustion and will cease operation. Further, the choke valve 60 can obstruct the flow of any water in the fluid passage 64 so that water in the fluid passage 64 does not flow into the airbox 30 and ultimately into the engine 22. Thus, the water ingestion control system 10 can stop or severely limit the flow of water into the engine 22 if the vehicle 12 is driven into a water obstacle that has a depth that exceeds the wading depth rating of the vehicle 12.

The water ingestion control system 10 can include a moisture sensor 66 that is located in the fluid passage 64 of the snorkel 58. The moisture sensor 66 can be any appropriate sensor that can transmit data to the controller 62 that is indicative of water moisture in the fluid passage of the snorkel 58. An electrical communication line 68 can electrically connect the moisture sensor 66 to the controller 62.

The choke valve 60 can be located between the moisture sensor 66 and the airbox 30 in the direction of flow A of fluid through the fluid passage 64. Thus, the moisture sensor 66 can detect the presence of water in the snorkel 58 before the water reaches the choke valve 60. To further enhance this advantage, the snorkel 58 can include an intermediate portion 70 that is lower in elevation than the choke valve 60 in the opening 42 with respect to the vertical direction V of the vehicle 12.

The snorkel 58 can include a first end 72 and a second end 74. The intermediate portion 70 can be located between the two ends 70, 74 and closer to the second end 74 than to first end 72 in the direction of flow A of fluid through the fluid passage 64. The choke valve 60 can be located adjacent to the second end 74. The first end 72 can be at an elevation with respect to the vertical direction V of the vehicle that is higher than the elevation of the second end 74 and the intermediate portion 70.

The intermediate portion 70 can be curved and can include a substantially U-shaped portion. The moisture sensor 66 can be located at the base of U-shaped portion of the intermediate portion 70 such that the moisture sensor 66 is located at the lowest elevation of the snorkel 58 with respect to the vertical direction V of the vehicle 12.

Figure 5:
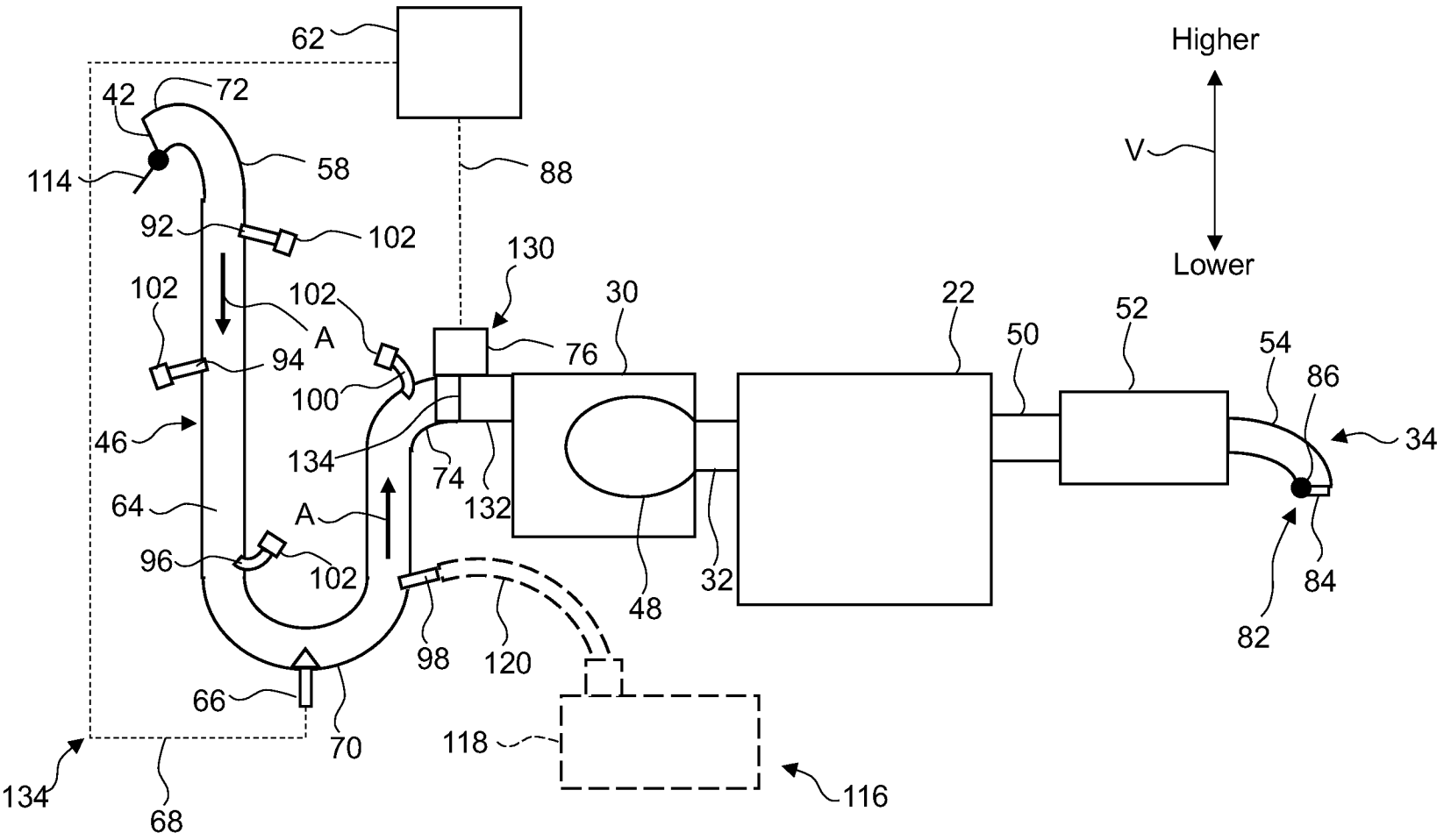
FIG. 5 is a schematic representation of a second embodiment of a water ingestion system and a second embodiment of a water evacuation system in accordance with principles of the disclosed subject matter.

The choke valve 60 can include an actuator 76, a valve body 78 and a shaft 80. The actuator 76 can be any appropriate actuator that can cause the shaft 80 to rotate the valve body 78 between an opened position and a closed position. FIG. 3 schematically shows the valve body 78 in the opened position. FIG. 5 schematically shows the valve body 78 in the closed position. The choke valve 60 is in the closed state when the valve body 78 is in the closed position and the choke valve 60 is in the opened state when the valve body 78 is in the opened position. In the closed position, the valve body 78 can seal the fluid passage 64 such that the valve body 78 prevents or severely limits a flow of fluid past the valve body 78 and into the air box 30.

An electrical communication line 88 can electrically connect the actuator 76 to the controller 62. The controller 62 can be configured to signal the actuator 76 to move the valve body 78 between the closed position and the open position based on the data received from the moisture sensor 66. For example, the moisture sensor 66 can be configured to transmit a first signal to the controller 62 that is indicative of the absence of water in the fluid passage 64 and transmit a second signal to the controller 62 that is indicative of the presence of water in the fluid passage 64. The controller 62 can be configured to signal the actuator 76 to move to the opened position when the controller 62 receives the first signal from the moisture sensor 66 and signal the actuator 76 to move the valve body 78 to the closed position when the controller 62 receives the second signal from the moisture sensor 66.

Referring to FIGS. 2 and 3, the exhaust system 34 can include an exhaust conduit 50, a muffler 52, and a tail pipe 54. If the engine 22 includes more than one piston and cylinder combination, the exhaust pipe 50 can include a respective fluid pathway for a respective one of the cylinders that can merge into a single fluid pathway connected to the muffler 52. The exhaust conduit 50 can be referred to as an exhaust manifold. Exhaust gas from the engine 22 can exit the exhaust system 34 by an opening 56 in the tailpipe 54.

The water ingestion control system 10 can include a one-way valve 82 that selectively opens and closes the opening 56 in the tailpipe 54. FIG. 3 schematically shows the one way valve 82 in the opened position. FIG. 5 schematically shows the one-way valve 82 in the closed position. The one-way valve 82 can be any appropriate valve that can permit exhaust gas to exit the opening 56 when the engine is operating and close automatically when the flow of exhaust gas through the opening ceases. For example, the one way valve 82 can include a flap 84 and a hinge 86 about which the flap 84 pivots. The flap 84 can be biased toward the closed position by any appropriate spring that has a spring force that can be overcome by the flow of exhaust gas through the tailpipe 54.

When the one-way valve 82 is in the closed position, the one-way valve 82 can close and seal the opening 56 in the tailpipe 54 such that little or no water can enter the tailpipe 54 if the opening 56 is partially or fully submerged in the water obstacle and the engine 22 stalls or is turned off.

If the vehicle 12 is inadvertently driven into a water obstacle that exceeds the wading depth rating of the vehicle 12 and water enters into fluid passage 64 of the snorkel 58, the water ingestion control system 10 can detect the presence of the water in the fluid passage 64 by way of the moisture sensor 66 and cause the controller 62 to signal the actuator 76 to move the valve body 78 from the opened position to the closed position. Since the valve body 78 can seal the fluid passage 64 when in the closed position, a flow of air and water past the valve body 78 can be prevented or diminished severely such that the engine 22 is starved of oxygen and the engine 22 ceases operation (or the ignition system of the engine 22 can be automatically turned off upon receipt of the signal that water is located at a certain location in the fluid passage 64 and/or simultaneously with actuation of actuator 76). When the engine 22 ceases operation, the flow of exhaust gas through the tailpipe 54 also stops and the one-way valve 82 automatically moves to the closed position and seals the opening 56 in the tailpipe 54. Therefore, the water ingestion control system 10 can prevent water from entering the airbox 30 and the engine 22 via the air intake system 46 and the exhaust system 34 if the vehicle is driven into a water obstacle that exceeds the wading depth rating of the vehicle 12.

Referring to FIG. 3, the vehicle 12 can further include a water evacuation system 90 that can be combined with the water ingestion control system 10 to form a water control and evacuation system. The water evacuation system 90 can include a plurality of evacuation inlets 92, 94, 96, 98, 100, a plurality of closure structures 102, an air compressor 104, a compressed air storage tank 106, and a plurality of air hoses 108, 110.

Each of the evacuation inlets 92, 94, 96, 98, 100 can include a hollow tube that has a first end opened in the fluid passageway 64 and a second end that is selectively sealed by a respective one of the closure structures 102. The closure structure can be any appropriate structure that allows the second end of each of the inlets 92, 94, 96, 98, 100 to be selectively opened and sealed closed such as but not limited to a threaded cap, a stopper plug, and a one-way valve. The threaded cap can be screw onto and off of mating threads on the second end of the inlets 92, 94, 96, 98, 100. The stopper plug can be a solid resilient structure made from rubber or other elastic material. The one-way valve can be located inside the inlets 92, 94, 96, 98, 100 and can be the same as or similar to a stem valve typically used with a pneumatic tire. The closure structure 102 is omitted from the fourth evacuation inlet 98 of FIG. 3 to more clearly show the second hose 110 connected to the fourth evacuation inlet 98. If the closure structure is configured as a stem valve, the second hose 110 can include an appropriate mating structure and a clamp such that the mating structure displaces the stem valve to an open position and the clamp holds the second hose onto the second end of the fourth inlet 98.

Each of the evacuation inlets lets 92, 94, 96, 98, 100 and the closure structures 102 can be described as a component of the snorkel 58 and a component of the water ingestion control system 10. The first second and third evacuation inlets 92, 94, 96 can be located between the first end 72 of the snorkel 58 and the moisture sensor 66. The first inlet 92 can be located closer to the first end 72 than to the moisture sensor 66. The third inlet 96 can be located closer to the moisture sensor 66 than to the first end 72. The fourth and fifth evacuation inlets 98, 100 can be located between the moisture sensor 66 and the second end 74 of the snorkel 58. The fourth and fifth evacuation inlets 98, 100 can be located between the moisture sensor 66 and the choke valve 60. The fourth inlet 98 can be located closer to the moisture sensor 66 than to the second end 74 and the choke valve 60. The fifth inlet 100 can be located closer to the choke valve 60 and the second end 74 than to the moisture sensor 66.

The air compressor 104 can be selectively driven by the engine 22. For example, the vehicle 12 can include a power takeoff unit 112 that is driven by the engine 22 and drives appropriate structure of the air compressor 104. The first hose 108 can connect the air compressor 104 to the compressed air storage tank 106 so that compressed air exiting the compressor 104 can enter into and be stored by the tank 106. That is, the compressor 104 can be in fluid communication with the tank 106.

The air compressor 104 and the compressed air storage tank 106 can be mounted on the vehicle 12 at any appropriate location that facilitates the usage and/or storage of the water evacuation system 90. In exemplary embodiments, one or both of the compressor 104 and the tank 106 can be removably mounted on the vehicle 12 when not in use and removed from the vehicle 12 when in use.

In the event that the vehicle 12 has been driven into a water obstacle that has a depth that exceeds the wading depth rating of the vehicle 12, and the water ingestion control system 10 has closed the choke valve 60, the water evacuation system 90 can be used to expel the water from inside the fluid passage 64. For example, the second hose 110 can be connected to the first evacuation inlet 92 such that the compressed air tank 106 is in fluid communication with the fluid passageway 64. Compressed air supplied from the tank 106 can enter the fluid passage 64 of the snorkel 58 and force water in the fluid passage 64 that is between the first end 72 and the first evacuation inlet 92. After expelling the water between the first evacuation inlet 92 and the first end 72, the second hose 110 can be disconnected from the first inlet 92 and connected to the second evacuation inlet 94. Compressed air can be supplied by the tank 106 to the second inlet 94 to expel water that is located between the first inlet 92 and the second inlet 94. This process can be repeated for each of the remaining evacuation inlets 96, 98, 100 until all of the water has been evacuated from the fluid passageway 64 of the snorkel 58. Thus, water ingested into the snorkel 58 can be easily evacuated from the fluid passage 64 without disassembling the air intake system 46 or removing the air intake system 46 from the engine 22 or the vehicle 12.

If desired, the evacuation process can be automated. For example, the second hose can be permanently connected to the evacuation inlet 102 and after a water ingestion incident, either upon user actuation or controller actuation, air can be discharged from the compressed air storage tank via inlet 102 to evacuate water from the snorkel 58. A push button, dial, or other actuation device can be located in the passenger compartment of the vehicle and connected to the ECU or other controller for the vehicle to cause the evacuation.

Alternatively, the ECU or other controller can be programed to automatically cause the evacuation under certain conditions (e.g., upon the vehicle being uprighted from a tipped or rolled position, upon a certain timing, upon sensing no water at the intake opening 42 or first end 72 of the snorkel 58, etc.).

Figure 4:
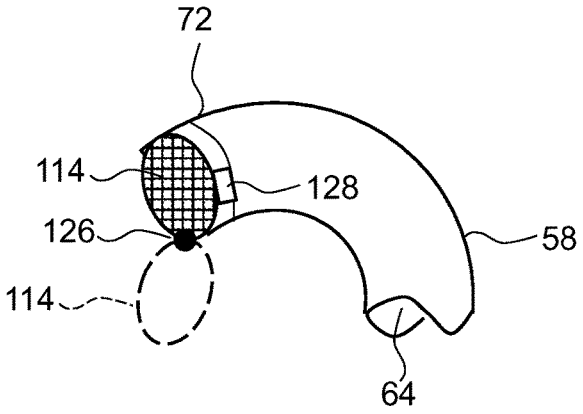
FIG. 4 is a perspective view of a portion of the water ingestion control system of FIG. 1.

Referring to FIGS. 3 and 4, the air intake system 46 can include a screen 114 that extends across the opening 42 in the snorkel 58. The screen 114 can filter large debris, such as but not limited to small stones, clumps of dirt, and leaves, so that the large debris does not enter the opening 42 in the first end 72 of the snorkel 58. The filter 48 can collect smaller debris such as but not limited to dust, dirt, and droplets of liquid, that passes through the screen 114 so that the smaller debris does not enter into the engine 22. The screen 114 can be movable between the covering position and an evacuation position. FIG. 3 shows the screen 114 in the evacuation position and FIG. 4 shows the screen 114 in the covering position (solid lines) and the evacuation position (phantom lines). The screen 114 can be moved to the evacuation position, which is spaced away from the first opening 42, while water is expelled from the fluid passage 64 of the snorkel 58. Placing the screen 114 in the evacuation position can facilitate the evacuation of water from the fluid passage 64 of the snorkel 58 by not obstructing the flow of water out of the first opening 42.

The screen 114 can include a hinge 126 and a fastener 128. The screen can pivot about the hinge 126 between the closed position and evacuation position. The fastener 128 can secure the screen to the exterior surface of the snorkel 58 when the screen 114 is in the closed position. The fastener 128 can be any appropriate fastener such as but not limited to a clamp, a hasp, a threaded fastener, or a latch.

FIG. 5 schematically illustrates alternate embodiments of a water ingestion control system 134 and a water evacuation system 116. Features common to both water ingestion control systems 10, 134 and both water evacuations systems 90, 116 are designated with the same reference numbers in FIGS. 3 and 5.

The compressor 104 and the compressed air storage tank 106 of the water evacuation system 90 of FIG. 3 are omitted from the water evacuation system 116 of FIG. 5. The water ingestion control system 134 of FIG. 5 includes a different layout of the choke valve 130 as compared to the choke valve of the water ingestion control system 10 of FIG. 3.

The water evacuation system 116 can include the plurality of evacuation inlets 92, 94, 96, 98, 100 and the plurality of closure structures 102. Instead of the air compressor 104, the compressed air storage tank 106, and the plurality of air hoses 108, 110, the inlets 92, 94, 96, 98, 100 can be connected to an external source 118 of compressed air via an air hose 120 as shown in phantom in FIG. 5. The external source of compressed air 118 can be located at a vehicle service center, or at a residence of the user/owner of the vehicle 12, or mounted on another vehicle, or portable away from another vehicle. The vehicle 12 can be transported, without operating the engine 22, from the water obstacle to the location of the external source of compressed air 118. The air hose 120 can be selectively connected to and disconnected from each of the evacuation inlets 92, 94, 96, 98, 100 as described above with respect to FIG. 3 in the event that water enters the fluid passage 64 of the snorkel 58. Thus, the water evacuation system 116 can evacuate water from the fluid passageway 64 of the snorkel without disconnecting the intake system 46 from the engine 22 or the vehicle 12.

The exemplary embodiment of FIG. 3 shows the valve body 78 mounted inside the snorkel 58 at a position that is spaced inwardly from the first end 74. Instead of the choke valve 60 of FIG. 3, the water ingestion control system 134 of FIG. 5 can include a choke valve 130 that is separate from the snorkel 58. The choke valve 130 can include a valve housing 132. The choke valve 130 can include a valve body 78 and an actuator 76 as described above with respect to the choke valve 60 of FIG. 3. The valve body 78 can be rotatably positioned within the valve housing 132. The valve housing 132 can be positioned between the second end 74 of the snorkel 58 and the air box 30.

The engine 22 can be mounted forward of the front axles, rearward of the rear axles, or intermediate the front and rear axles. In the exemplary embodiment of FIGS. 1 and 2, the engine is configured as a longitudinally-oriented rear-mounted internal combustion engine.

Electrical communication between the controller 62 and each of the choke valve 60 and the moisture senor 66 can be either one-way communication or two-way communication and can be networked or not networked. The controller 62 also can be referred to as an electronic control unit (ECU) or as a central processing unit. The actuator 76 and the moisture sensor 62 can be configured with hardware, with or without software, to perform the assigned task(s). The sensor 66 can be configured as a smart sensor such that the sensor 66 can process the raw data collected by the sensor 66 prior to transmission to the ECU 62, or the sensor 66 can be configured as a simple sensor that passes the raw data directly to the ECU 62 without any manipulation of the raw data. The sensor 66 can be configured to send data to the ECU 62, with or without a prompt from the ECU 62.

Electrical communication lines 122, 124 can connect the ECU 62 to the intake conduit 32 and the engine 22. The ECU 62 can send and receive signals to sensor(s) and actuator(s) located in the intake conduit 32 and the engine 22. The ECU 62 can monitor and manipulate the operation of the engine 22 based on the sensor data and the actuator signal(s). The ECU 62 can also be referred to as an engine ECU 62.

Accordingly, a water ingestion control system made in accordance with the disclosed subject matter can prevent or severely limit the amount of water that can enter an internal combustion engine if the vehicle is to drive into a water obstacle whose depth exceeds a predetermined wading depth rating for the vehicle. Thus, water ingestion control system can avoid significant damage to the engine that might otherwise be caused by water ingested into the engine.

Further, the described water ingestion control system can be combined with water evacuation system(s) made in accordance with disclosed subject matter. The water evacuation system can supply compressed air into the water ingestion control system and cause water in the water ingestion control system to evacuate the water ingestion control system without disassembling the engine, or the air intake system for the engine, or the exhaust system for the engine.

While certain embodiments of the invention are described above, it should be understood that the invention can be embodied and configured in many different ways without departing from the spirit and scope of the invention.

For example, embodiments are disclosed above in the context of vehicle 12 shown in FIGS. 1 and 2 that is specialized for traveling on unimproved paths and unmarked paths. However, exemplary embodiments of the water ingestion control system 10 and the water evacuation systems 90, 116 can be implemented on any appropriate vehicle that might encounter a water obstacle.

The exemplary choke valve 60 described above can be referred to as a butterfly valve. However, exemplary embodiments can include any appropriate valve structures that can selectively open and seal close the fluid passage 64. For example, the choke valve 60 can include a flap that is connected to the inner wall of the fluid passage 64 by a hinge. The actuator 76 can be configured to cause the flap to move between an opened position, where the flap lies adjacent to the inner wall of the snorkel 58 and does not obstruct the flow of fluid through the fluid passage 64, and a closed position where the flap pivots away from the inner wall in seals closed the fluid passage 64.

The exemplary embodiments described above can include the five evacuation inlets 92, 94, 96, 98, 100. However, exemplary embodiments can include any appropriate number of evacuation inlets, including, a single evacuation inlet for the entire snorkel. In exemplary embodiments that include more than one evacuation inlet, the evacuation inlets can be distributed along the length of the snorkel 58 with an even spacing or an uneven spacing.

The exemplary moisture sensor 66 is described above as sending first and second signals corresponding to the absence and presence of water, respectively. However, an exemplary embodiment of the water ingestion control system can include a moisture sensor that is configured to send a single signal that is indicative of the presence of water in the fluid passage 64 and to not send a signal when there is an absence of water in the fluid passage 64. In this alternate embodiment, the controller can be configured to signal the actuator to move or maintain the valve body in the opened position.

In exemplary embodiments, the screen 114 can be omitted or permanently fixed to the first end 72 of the snorkel such that the screen 114 remains in place when water is evacuated from the snorkel 58.

Exemplary embodiments can include the water ingestion and evacuation system configured as an after-market or replacement kit that can replace an existing air intake system or replace a damaged water ingestion and evacuation system. FIG. 5 shows an exemplary embodiment of a kit where the controller 62 is a stand-alone controller that is dedicated to the water ingestion control system. Thus, the controller 62 lacks electrical communication with sensor(s) and actuators of the intake pipe 32 and the engine 22. However, the controller 62 can be incorporated into one of the controller(s) of the vehicle itself.

An exemplary method of evacuating water from the fluid passage 64 of the snorkel 58 included connecting a supply of compressed air to the first evacuation inlet 92 and then sequentially connecting the supply of compressed air to each of the remaining inlets 94, 96, 98, 100. However, exemplary methods of evacuating the water from the fluid passage 64 can include connecting the supply of compressed air to the inlets 92, 94, 96, 08, 100 in any order that is desired. Further, exemplary methods of evacuating the water from the fluid passage 64 can include skipping over any one of the inlets 92, 94, 96, 98, 100 when connecting the supply of compressed air to the fluid passage 64. Exemplary methods of evacuating water from the fluid passage can include connecting all of the inlets 92, 94, 96, 98, 100 to the supply of compressed air simultaneously. As indicated above, compressed air can be permanently connected to any one or all of the inlets 92, 94, 96, 98, 100 to the supply of compressed air such that the evacuation process can happen automatically and/or at discretion of the user/driver without the need to connect hoses to one or more of the inlet(s) 92, 94, 96, 98, 100.

What is claimed is:

1. A water ingestion control system for an internal combustion engine connected to an air box and an exhaust pipe, the water ingestion control system comprising: a snorkel connected to the air box and including an air intake opening and a plurality of evacuation inlets spaced apart from each other; a plurality of closure structures, a respective one of the closure structures selectively opens and closes a respective one of the evacuation inlets; a choking valve located between the air intake opening and the air box and selectively operated between, an opened state in which the choking valve opens fluid communication between the snorkel and the air box and allows air flowing through the snorkel to enter the air box, and a closed state in which the choking valve closes fluid flow into the air box and prevents fluid in the snorkel from flowing into the air box and the internal combustion engine; and a controller in electrical communication with the choking valve and configured to place the choking valve in the closed state when the controller receives data indicative of the presence of water in the snorkel.

2. The water ingestion control system according to claim 1, further comprising:

a moisture sensor mounted inside the snorkel and in electrical communication with the controller, the moisture sensor is configured to send to the controller the data indicative of the presence of water in the snorkel.

3. The water ingestion control system according to claim 2, wherein the snorkel includes a first end, a second end, and a bend between the first end and the second end, the first end and the second end are located at an elevation in a vertical direction of the vehicle that is greater than an elevation of the bend in the vertical direction, the moisture sensor is located in the bend, and at least one of the evacuation inlets is spaced away from the bend.

4. The water ingestion control system according to claim 2, wherein one of the evacuation inlets is located between the moisture sensor and the choking valve.

5. The water ingestion control system according to claim 2, wherein more than one of the evacuation inlets is located between the moisture sensor and the air intake opening; and more than one of the evacuation inlets is located between the moisture sensor and the choking valve.

6. The water ingestion control system according to claim 2, wherein the choking valve includes an actuator and a valve body rotatably driven by the actuator between an opened position that corresponds to the opened state and a closed position that corresponds to the closed state, the valve body is biased to the opened position, and the controller is in electrical communication with the actuator and configured to cause to actuator to move the valve body to the closed position when the controller receives from the moisture sensor the data that is indicative of the presence of water in the snorkel.

7. The water ingestion control system according to claim 1, further comprising:

a one-way valve located in the exhaust pipe, the one-way valve opens when exhaust gas exits the internal combustion engine and flows through the exhaust pipe, and the one-way valve closes when exhaust gas ceases to flow through the exhaust pipe.

8. The water ingestion control system according to claim 1, further comprising:

a compressed air storage tank; and at least one line configured for connecting the compressed air storage tank to at least one of the plurality of evacuation inlets.

9. The water ingestion control system according to claim 8, further comprising:

an air compressor connected to the compressed air storage tank and configured to maintain a predetermined pressure in the compressed air storage tank.

10. The water ingestion control system according to claim 9, further comprising:

a screen extending across the air intake opening, wherein the screen is pivotally connected to the first end of the snorkel and selectively movable between a closed position where the screen extends across the air intake opening and a second position where the screen is spaced away from the air intake opening.

11. The water ingestion control system according to claim 1, wherein each of the closure structures is one of a threaded cap, a stopper plug and a one-way valve.

12. A method for evacuating water ingested by an air intake system of an internal combustion engine of a vehicle, comprising:

providing the intake system with the water ingestion control system according to claim 1;

connecting a source of compressed air to one of the evacuation air inlets while the controller operates the choking valve in the closed state;

pressurizing the snorkel with compressed air from the source of compressed air until water previously ingested into the snorkel is forced out of the snorkel by the compressed air;

disconnecting the source of compressed air from the one of the evacuation inlets; and repeating the connecting, the pressurizing, and the disconnecting for each of the evacuation inlets until the water ingested into the snorkel is evacuated from the snorkel.

13. A vehicle comprising:

a frame assembly;

at least one body panel mounted on the frame assembly;

an internal combustion engine mounted on the frame assembly;

an airbox housing a filter;

a snorkel connected to the air box and including an air intake opening and at least one evacuation inlet;

a closure structure configured to close the at least one evacuation inlet;

a choking valve between the air intake opening and the air box and selectively operated between, an opened state in which the choking valve opens fluid communication between the snorkel and the air box and allows air flowing through the snorkel to enter the air box and flow into the internal combustion engine, and a closed state in which the choking valve closes fluid communication between the air box and the internal combustion engine and prevents fluid in the snorkel from exiting the snorkel and flowing into the air box and the internal combustion engine;

a controller in electrical communication with the choking valve and configured to place the choking valve in the closed state when the controller receives data indicative of the presence of water in the snorkel;

a compressed air storage tank;

at least one line configured for connecting the compressed air storage tank to the at least one evacuation inlet; and an air compressor connected to the compressed air storage tank and configured to maintain a predetermined pressure in the compressed air storage tank.

14. The vehicle according to claim 13, wherein the inlet of the snorkel is covered by the body panel and adjacent to one of the rear wheels.

15. The vehicle according to claim 13, further comprising:

a moisture sensor, wherein the snorkel includes a first end, a second end, and an intermediate portion between the first end and the second end, the first end and the second end are located at an elevation in a vertical direction of the vehicle that is greater than an elevation of the intermediate portion in the vertical direction, the moisture sensor is located in the intermediate portion.

16. The vehicle according to claim 15, further comprising:

an exhaust pipe in fluid communication with the internal combustion engine such that exhaust gas exiting the engine flows into the exhaust pipe; and a one-way valve located in the exhaust pipe, the one-way valve opens when exhaust gas flows through the exhaust pipe and closes when exhaust gas ceases to flow through the exhaust pipe.

17. The vehicle according to claim 16, wherein the air compressor is selectively driven by the internal combustion engine; the at least one line includes a first air hose connecting the air compressor to the air tank for fluid communication therebetween such that air compressed by the compressor flows through the first air hose into the air tank; and a second air hose connected to the air tank and selectively connected to the evacuation inlet, the second air hose in fluid communication with the air tank and the snorkel when connected to the evacuation inlet such that compressed air in the air tank flows through the second air hose and into the snorkel, wherein the evacuation inlet is located between the moisture sensor and the second end.

18. A water ingestion and evacuation system for a vehicle including an internal combustion engine, an air box connected to the engine and an exhaust pipe connected to the engine, comprising:

a snorkel connected to the air box and including a first end, a second end, an air intake opening at the first end, and at least one evacuation inlet spaced apart from each of the first end and the second end;

a closure structure closing the at least one evacuation inlet;

a choking valve located between the air intake opening and the air box and selectively operated between, an opened state in which the choking valve opens fluid communication between the snorkel and the air box and allows air flowing through the snorkel to enter the air box, and a closed state in which the choking valve closes fluid communication between the snorkel and the air box and prevents fluid in the snorkel from flowing into the air box and the internal combustion engine;

a moisture sensor;

a controller in electrical communication with the choking valve and the moisture sensor and configured to place the choking valve in the closed state when the controller receives from the moisture sensor the data indicative of the presence of water in the snorkel; and a one-way valve mounted on the exhaust pipe, the one-way valve opens when the choking valve is in the opened state and exhaust gas flows through the exhaust pipe and closes when the choking valve is in the closed state and exhaust gas ceases to flow through the exhaust pipe.

19. The water ingestion and evacuation system according to claim 18, wherein the snorkel includes a first end, a second end, and an intermediate portion between the first end and the second end, the first end and the second end are located at an elevation in a vertical direction of the vehicle that is greater than an elevation of the intermediate portion in the vertical direction, the moisture sensor is located in the intermediate portion.

20. The water ingestion and evacuation system according to claim 18, further comprising:

a source of compressed air; and an air hose connected to the source of compressed air and the evacuation inlet for fluid communication therebetween such that compressed air from the source of compressed air flows through the air hose into the snorkel.

* * * * *